US012310513B2

(12) United States Patent
Van Faasen et al.

(10) Patent No.: US 12,310,513 B2
(45) Date of Patent: May 27, 2025

(54) SEATING STRUCTURE

(71) Applicant: MillerKnoll, Inc., Zeeland, MI (US)

(72) Inventors: Joel Graham Van Faasen, Holland, MI (US); James D. Slagh, Holland, MI (US); Lauren Mary LaLonde, Saugatuck, MI (US); Jonathan Curtis Campbell, Holland, MI (US); John F. Aldrich, Grandville, MI (US); Timothy Allen Hoogland, Zeeland, MI (US); Robert W. Roth, Holland, MI (US); Brock M. Walker, Okemos, MI (US)

(73) Assignee: MillerKnoll, Inc., Zeeland, MI (US)

( * ) Notice: Subject to any disclaimer, the term of this patent is extended or adjusted under 35 U.S.C. 154(b) by 140 days.

(21) Appl. No.: 17/940,695

(22) Filed: Sep. 8, 2022

(65) Prior Publication Data

US 2023/0073826 A1 Mar. 9, 2023

Related U.S. Application Data

(60) Provisional application No. 63/241,641, filed on Sep. 8, 2021.

(51) Int. Cl.

| | |
|---|---|
| ***A47C 7/46*** | (2006.01) |
| ***A47C 7/28*** | (2006.01) |
| ***A47C 7/38*** | (2006.01) |

(52) U.S. Cl.

CPC ..... *A47C 7/462* (2013.01); *A47C 7/282* (2013.01); *A47C 7/38* (2013.01)

(58) Field of Classification Search

CPC ..... A47C 7/282; A47C 7/462; A47C 7/38; B60N 2/838; B60N 2/865

(Continued)

(56) References Cited

U.S. PATENT DOCUMENTS 3,027,194 A * 3/1962 Rumptz ..... B60N 2/818 297/410
3,300,249 A * 1/1967 Schneider ..... A61G 15/125 297/408

(Continued)

FOREIGN PATENT DOCUMENTS

CN 201147054 Y 11/2008
CN 101332783 A 12/2008

(Continued)

OTHER PUBLICATIONS

International Search Report and Written Opinion for Application No. PCT/US22/42918 dated Feb. 2, 2023 (13 pages).

(Continued)

*Primary Examiner* — Milton Nelson, Jr.
(74) *Attorney, Agent, or Firm* — Michael Best & Friedrich LLP

(57) ABSTRACT

A seating structure includes a base, a seat supported by the base, and a backrest having a frame and a suspension material supported by the frame. The frame includes an upper end and a lower end opposite the upper end. The seating structure also includes an upper thoracic support assembly supported by the frame adjacent the upper end. The upper thoracic support assembly including a thoracic support pad positioned between the frame and the suspension material. The thoracic support pad configured to engage the suspension material to support an upper thoracic region of a user.

24 Claims, 12 Drawing Sheets

(58) Field of Classification Search
USPC ..... 297/452.56, 284.8, 408
See application file for complete search history.

(56) References Cited

U.S. PATENT DOCUMENTS 3,542,428 A * 11/1970 Colucci ..... B60N 2/829 297/410
4,162,807 A * 7/1979 Yoshimura ..... A47C 7/462 267/89
4,515,406 A * 5/1985 Fujiyama ..... A61G 15/125 297/391
4,647,108 A * 3/1987 Hayashi ..... A47C 7/38 297/391
4,863,218 A * 9/1989 McCrackin ..... A61G 15/125 297/391
5,913,536 A 6/1999 Brown
6,322,142 B1 11/2001 Yoshida et al.
6,367,876 B2 4/2002 Caruso et al.
6,530,622 B1 3/2003 Ekern et al.
6,616,236 B1 9/2003 Su
6,719,373 B2 4/2004 Zimmermann
6,755,472 B2 6/2004 Stenzel et al.
6,789,845 B2 9/2004 Farquhar et al.
6,857,704 B2 2/2005 Stenzel et al.
6,863,286 B2 3/2005 Eros et al.
6,893,096 B2 5/2005 Bonn et al.
6,923,502 B2 8/2005 Cassaday
6,962,392 B2 11/2005 O'Connor
7,055,909 B2 * 6/2006 Wu ..... A47C 7/38 297/391
7,097,246 B2 * 8/2006 Sedlatschek ..... A47C 7/38 297/284.3
7,188,909 B2 3/2007 Cassaday
7,207,596 B2 4/2007 Linder et al.
7,207,628 B2 4/2007 Eros et al.
7,240,966 B2 7/2007 Stone et al.
7,396,079 B2 7/2008 Heidmann et al.
7,413,250 B2 8/2008 Connolly et al.
7,458,637 B2 12/2008 Norman et al.
D584,908 S 1/2009 Diffrient
7,500,721 B2 * 3/2009 Beroth ..... B64D 11/0642 297/410
7,625,046 B2 12/2009 Sanchez
7,690,729 B2 4/2010 Liao
7,703,849 B2 * 4/2010 Bilak ..... A47C 7/462 297/284.6
7,806,478 B1 10/2010 Cvek
7,832,803 B2 11/2010 Cassaday
7,887,135 B2 2/2011 Oda
7,922,248 B2 4/2011 Aldrich et al.
8,033,601 B2 * 10/2011 Otsuka ..... B60N 2/838 297/216.12
8,056,857 B2 11/2011 Dowty et al.
8,123,295 B2 2/2012 Hutchinson et al.
8,449,037 B2 * 5/2013 Behar ..... A47C 7/46 297/297
8,474,909 B2 * 7/2013 LaPointe ..... A47C 7/462 297/284.4
8,562,072 B2 10/2013 Ishimoto et al.
8,622,467 B2 1/2014 Murphy et al.
8,662,591 B2 3/2014 Lin
D706,566 S 6/2014 Giugiaro
8,944,977 B2 2/2015 Foster et al.
9,315,130 B2 4/2016 Kondrad et al.
9,352,675 B2 5/2016 Walker et al.
D758,774 S 6/2016 Smith et al.
D760,526 S 7/2016 Smith et al.
9,380,878 B1 7/2016 Chen
9,521,908 B1 12/2016 Beck et al.
D779,255 S 2/2017 Welsh et al.
9,561,744 B2 2/2017 Galbreath et al.
9,889,773 B2 2/2018 Line et al.
D823,626 S 7/2018 Chen
10,010,182 B1 7/2018 Chen
10,085,562 B1 10/2018 Labrosse et al.
10,219,966 B2 3/2019 Benfield et al.
10,238,215 B2 3/2019 Peterson et al.
10,251,487 B2 4/2019 Galbreath et al.
10,258,820 B2 4/2019 Harlow
10,264,890 B2 * 4/2019 Aldrich ..... A47C 7/462
10,299,601 B2 * 5/2019 Speicher ..... B60N 2/865
10,455,945 B2 10/2019 Zouzal et al.
10,493,882 B1 12/2019 Romelfanger et al.
10,500,997 B2 12/2019 Maloney et al.
D874,860 S 2/2020 Schmitz et al.
10,595,637 B2 3/2020 Paul et al.
10,602,847 B2 3/2020 Zouzal et al.
D893,229 S 8/2020 Borgenhov et al.
10,874,221 B1 12/2020 Lin
D927,908 S 8/2021 Chen
D929,165 S 8/2021 Guo
D944,025 S 2/2022 Buffon
D959,867 S 8/2022 Feng
D960,597 S 8/2022 Cross et al.
D964,781 S 9/2022 Yang
2001/0054836 A1 * 12/2001 Vik ..... A47C 7/46 297/284.8
2002/0043841 A1 * 4/2002 Giacinto ..... A47C 7/38 297/284.7
2002/0190552 A1 12/2002 Koepke et al.
2004/0140701 A1 7/2004 Schmitz et al.
2004/0195875 A1 10/2004 Skelly
2005/0062323 A1 3/2005 Picks
2006/0226688 A1 10/2006 Terada et al.
2008/0007105 A1 * 1/2008 Viger ..... A47C 7/38 297/408
2008/0217971 A1 9/2008 Paluch
2010/0127544 A1 5/2010 Panchbhaya
2010/0176632 A1 7/2010 Alford et al.
2013/0257419 A1 10/2013 Greenwell et al.
2016/0031351 A1 * 2/2016 Galbreath ..... B60N 2/66 297/284.1
2016/0100691 A1 4/2016 Masunaga et al.
2016/0157617 A1 6/2016 Galbreath et al.
2016/0374475 A1 12/2016 Aldrich et al.
2017/0127844 A1 5/2017 Grone
2017/0225591 A1 8/2017 Tobata et al.
2017/0282757 A1 10/2017 Line et al.
2019/0184878 A1 6/2019 Milner et al.
2019/0192901 A1 6/2019 Harlow
2020/0010199 A1 1/2020 Ferguson et al.
2020/0046587 A1 2/2020 Furman et al.
2020/0138194 A1 5/2020 Todd et al.
2020/0146452 A1 5/2020 Chen
2020/0329861 A1 10/2020 Zhang
2020/0376994 A1 12/2020 Kuroda et al.
2021/0244190 A1 8/2021 Mazlish
2023/0040114 A1 * 2/2023 Palma ..... A47C 7/443

FOREIGN PATENT DOCUMENTS

CN 201264546 Y 7/2009
CN 204862053 U 12/2015
CN 204889274 U 12/2015
CN 109380907 A 2/2019
EP 164267 A * 12/1985 ..... A47C 1/032
JP H0713566 Y2 * 4/1995
WO WO-0160209 A1 * 8/2001 ..... A47C 7/402
WO 2005021318 A1 3/2005
WO WO-2014019566 A1 * 2/2014 ..... B60N 2/829
WO WO-2018050797 A1 * 3/2018 ..... B60N 2/809
WO 2019188107 A1 10/2019
WO 2020043827 A1 3/2020

OTHER PUBLICATIONS

International Preliminary Report on Patentability for Application No. PCT/US2022/042918 dated Mar. 5, 2024 (6 pages).

* cited by examiner

SEATING STRUCTURE

CROSS REFERENCE TO RELATED APPLICATION

This application claims the benefit of U.S. Provisional Patent Application No. 63/241,641, filed on Sep. 8, 2021, the entire content of which is incorporated herein by reference.

FIELD OF THE INVENTION

The present invention relates to a seating structure, and in particular, to a seating structure, such as a chair, having a seat, a backrest, a base and a headrest.

SUMMARY

In one aspect, the invention provides, a seating structure including a base, a seat supported by the base, and a backrest having a frame and a suspension material supported by the frame. The frame includes an upper end and a lower end opposite the upper end. The seating structure also includes an upper thoracic support assembly supported by the frame adjacent the upper end. The upper thoracic support assembly including a thoracic support pad positioned between the frame and the suspension material. The thoracic support pad configured to engage the suspension material to support an upper thoracic region of a user.

In another aspect, the invention provides, a seating structure including a base, a seat supported by the base, a backrest having a frame, and a headrest assembly supported by the backrest. The headrest assembly includes a stem coupled to and extending from the frame and a headrest coupled to the stem. The headrest is pivotable relative to the stem about a virtual pivot axis positioned on a same side of the backrest as the seat.

In another aspect, the invention provides, a seating structure including a base, a seat supported by the base, a backrest having a frame and a suspension material coupled to the frame, and a lumbar support assembly coupled to the backrest. The lumbar support assembly includes a support bracket having a first end pivotably coupled to the frame and a second end opposite the first end, a lumbar support pad coupled to the second end of the support bracket, and an adjustment member positioned between the support bracket and the frame. The adjustment member includes a cam member. The cam member is rotatable about a rotational axis to engage the support bracket and adjust the position of the lumbar support pad relative to the suspension material.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

To avoid crowding the drawings with reference numbers for different ends, sides, etc. of parts of the chair, it will be presumed that one of ordinary skill will read this disclosure with the ordinary meaning of directional and positional terms in mind. Throughout this disclosure, for example, the terms "left," "right," "rear," "front," "forward," and "rearward" are used from the perspective of an occupant or user seated in the chair. Terms such as "top" and "bottom" are used with respect to the intended ordinary condition of the chair. The term "above" means that one component is positioned higher than another with necessarily being in the same vertical plane. The term "vertically above" means that one component is higher than another thing and in the same vertical plane. "Below" means a component is lower than another component, whereas "vertically below" means that the component is lower and also within the same vertical plane as the other component.

DETAILED DESCRIPTION

Figure 1:
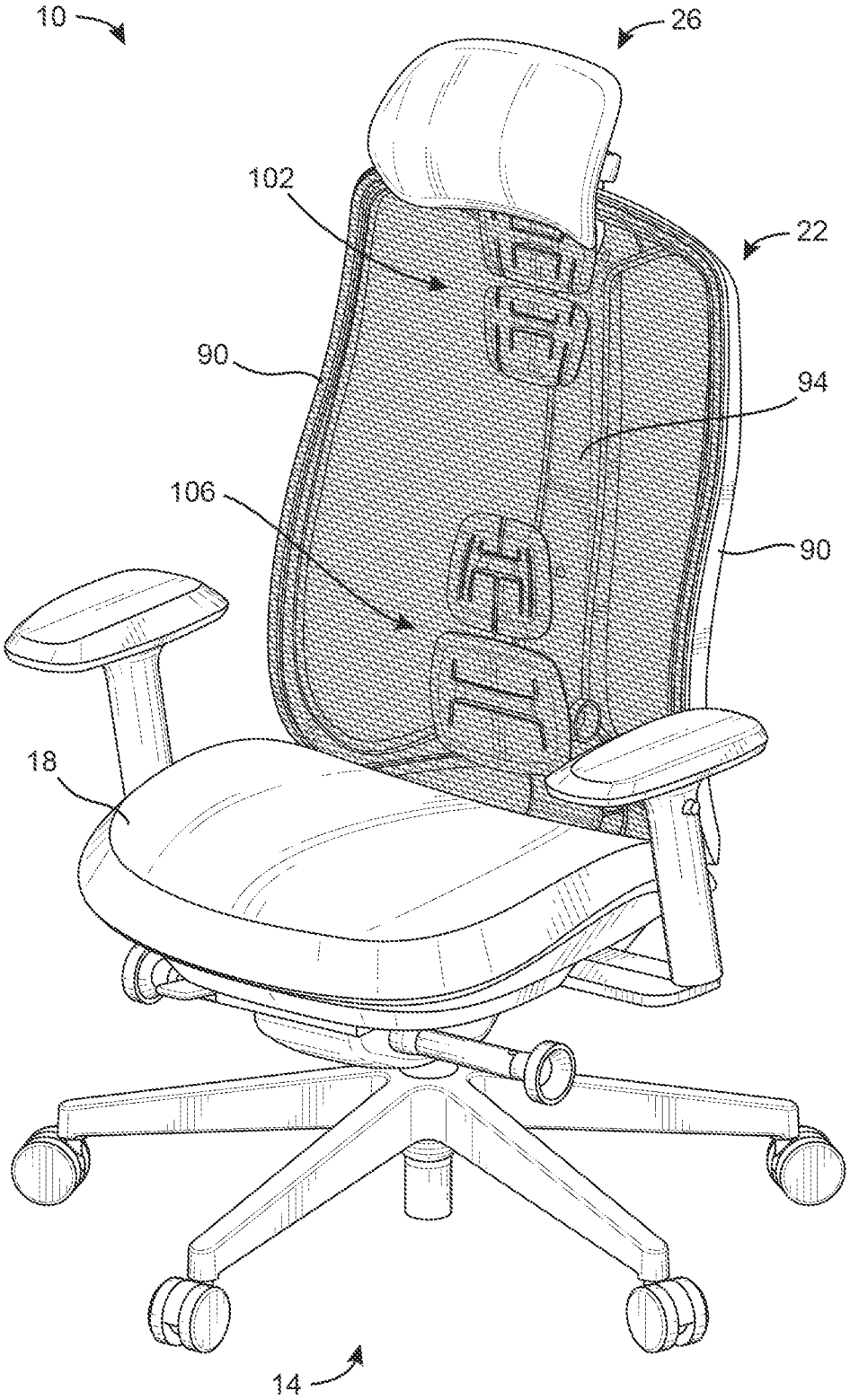
FIG. 1 is a perspective view of a seating structure.

FIG. 1 illustrate a seating structure 10, such as a chair. The seating structure 10 may also be referred to as a task chair or office chair. The seating structure 10 includes a base 14, a seat 18, a backrest 22, and a headrest assembly 26 supported by the backrest 22. Various aspects of the seating structure 10 may be adjustable to fit different sizes or preferences of users. In some embodiments, the headrest assembly 26 may be omitted or included as an aftermarket addition.

Figures 2, 3, 4:
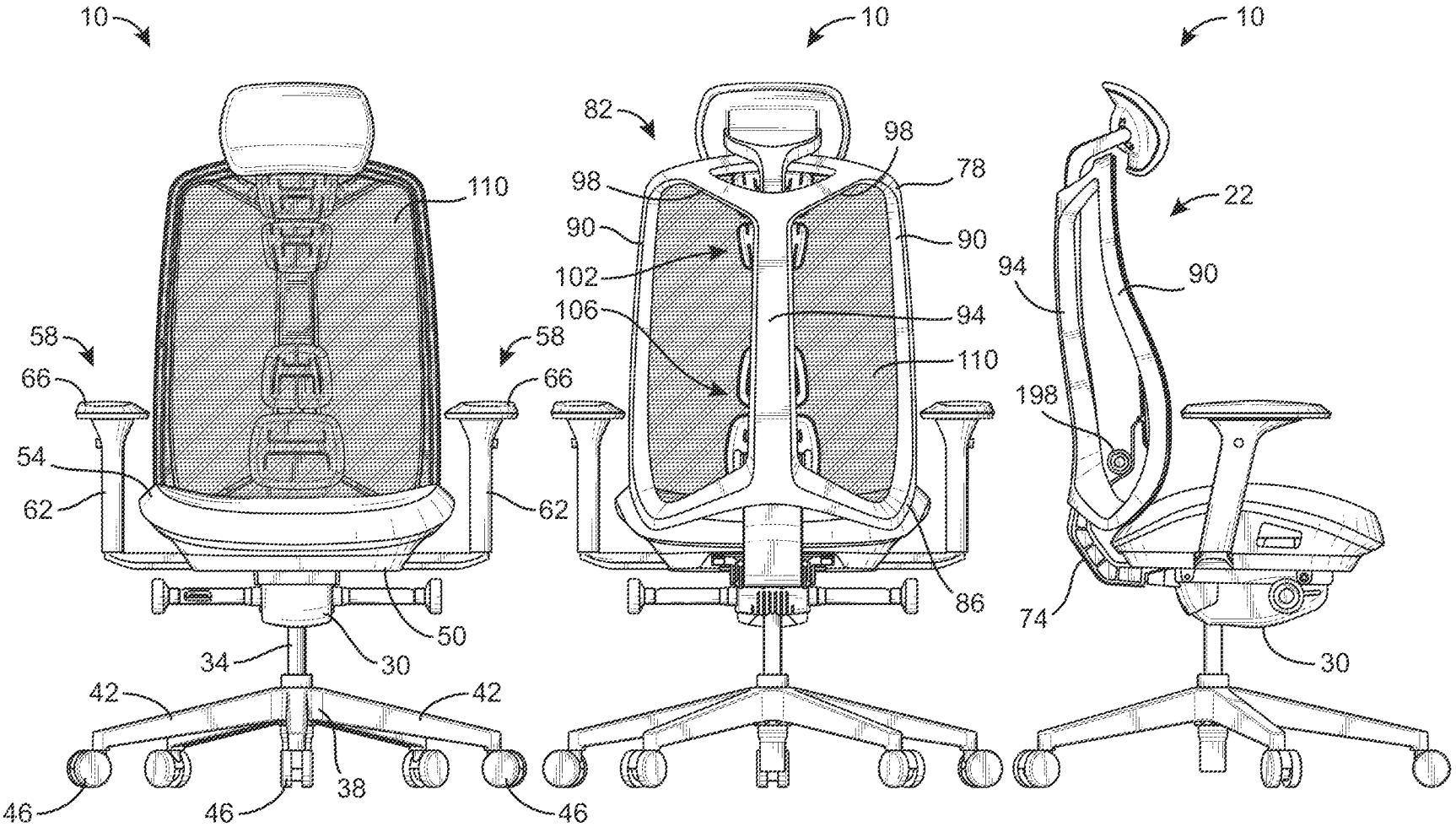
FIG. 2 is a front view of the seating structure of FIG. 1.
FIG. 3 is a back view of the seating structure of FIG. 1
FIG. 4 is a side view of the seating structure of FIG. 1.

Moving to FIG. 2, the base 14 includes a tilt mechanism 30, a support column 34 coupled to and supporting the tilt mechanism 30, and a base structure 38 coupled to and supporting the support column 34. The base structure 38 includes a plurality of feet 42 that extend outward from a center portion of the base structure 38. In the illustrated embodiment, each of the feet 42 supports a caster or wheel 46 that allows the seating structure 10 to move along a surface. In other embodiments, the base structure 38 may not include the wheels 46. The base structure 38 is rotatable about the support column 34. In other words, the seat 18 and the backrest 22 are rotatable about the base 14 in order to change the facing direction of a user sitting in the seating structure 10 relative to the base structure 38. The support column 34 is also vertically adjustable. In the illustrated embodiment, the support column 34 includes a plurality of telescoping tubes that move to adjust the height of the seat 18. In some embodiments, the support column 34 may be powered by a pneumatic system that drives movement of the telescoping tubes. Further, the support column 34 may be adjusted using an adjustment member that controls operation of the pneumatic system. In other embodiments, the seating structure 10 may include other types of bases. For example, the seating structure 10 may include a base having four stationary legs, or the seating structure 10 may include a base suitable for stool or counter height.

The seat 18 is coupled to the tilt mechanism 30 above the support column 34. The illustrated seat 18 includes a skirt 50 and a cushion 54 supported by the skirt 50. In the illustrated embodiment, the cushion 54 is a foam cushion covered by a fabric or textile material. In other embodiments, the seat 18 may include suspension material instead of the cushion 54 to support a user. In addition, the seat 18 may have various shapes and forms to provide different aesthetic appearances of the seating structure 10.

The seating structure 10 also includes a pair of armrests 58. The illustrated armrests 58 are coupled to the seat 18. In other embodiments, the armrests 58 may be coupled to other portions of the seating structure 10. In the illustrated embodiments, the armrests 58 are disposed within cavities formed by side uprights 62. The side uprights 62 extend from the skirt 50 of the seat 18. Each armrest 58 includes an arm support 66 that is coupled to a stem. The stem is disposed within a corresponding one of the cavities of the side uprights 62. The arm support 66 may include a foam padding to provide cushion to a user's arms when sitting in the seating structure 10. In various embodiments, the armrests 58 are vertically adjustable, by way of the stem moving relative to the side uprights 62. The armrests 58 may have various shapes and forms to provide different aesthetic appearances of the seating structure 10.

The backrest 22 is coupled to the tilt mechanism 30 through a bracket 74 (FIG. 4). In the illustrated embodiment, the bracket 74 is a C-shaped bracket. In other embodiments, other suitable brackets may be used. With reference to FIG. 3, the backrest 22 includes a frame 78 having an upper end 82 and a lower end 86. The backrest 22 also includes two outer uprights 90 opposite each other and a central spine 94 between the outer uprights 90. The central spine 94 extends between the upper end 82 and the lower end 86 of the frame 78. In the illustrated embodiment, the outer uprights 90 and the central spine 94 are contiguous to form the frame 78. As shown in FIG. 4, the outer uprights 90 are convex at a lower portion of the frame 78. In other words, a lower portion of the outer uprights 90 have a convex portion facing the forward side of the seating structure 10. Further, the central spine 94 is positioned rearward of the outer uprights 90 as viewed from FIG. 4. The backrest 22 may have various shapes and forms to provide different aesthetic appearances of the seating structure 10.

The central spine 94 includes a pair of arms 98 that diverge outwardly and upwardly to connect the central spine 94 to the upper end 82 of the frame 78. The arms 98 and the upper end 82 of the frame 78 create an opening through which the headrest assembly 26 is disposed. In other words, the arms 98 wrap around a portion of the headrest assembly 26 and connect back to the upper end 82 of the frame 78 to form the opening. The frame 78 also supports an upper thoracic support assembly 102 and a lumbar support assembly 106 as will be discussed in more detail below. A suspension material 110 is supported by the frame 78. The suspension material 110 is coupled to the perimeter of the frame 78 in tension so that the suspension material 110 can support the back of a user sitting in the seating structure 10. In some embodiments, the suspension material 110 may be a flexible elastomeric material that includes a plurality of monofilaments and multifilament that are woven together. The suspension material 110 may alternatively be a knit material, such as a 3D knit fabric. In other embodiments, the suspension material 110 may be a different arrangement or formed of different materials or combinations of materials. In still other embodiments, the backrest 22 may include a relatively rigid shell and a pad coupled to the shell, instead of the suspension material 110.

Figure 5:
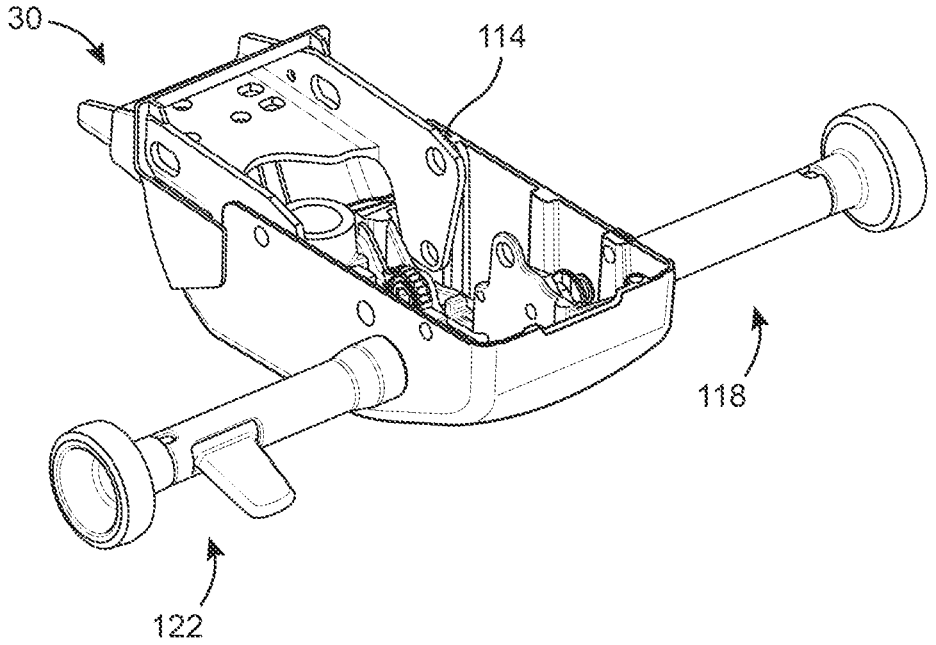
FIG. 5 is a perspective view of a tilt mechanism for the chair of FIG. 1.

As shown in FIG. 5, the tilt mechanism 30 includes a tilt housing 114, a first control member 118 or actuator, and a second control member 122 or actuator. In the illustrated embodiment, the first control member 118 is a tilt limiter to control the maximum range of tilt the backrest 22 can pivot relative to the seat 18. The second control member 122 is a tilt tensioner that controls the amount of force required to recline or tilt the backrest 22 relative to the seat 18. Both the first control member 118 and the second control member 122 include quantitative feedback indicators that indicate to a user the current setting of the control members 118, 122. Although, both the first control member 118 and the second control member 122 include quantitative feedback indicators, for simplicity, only the second control member 122 will be described in greater detail. The first control member 118 operates in a similar manner as the second control member 122.

Figure 6:
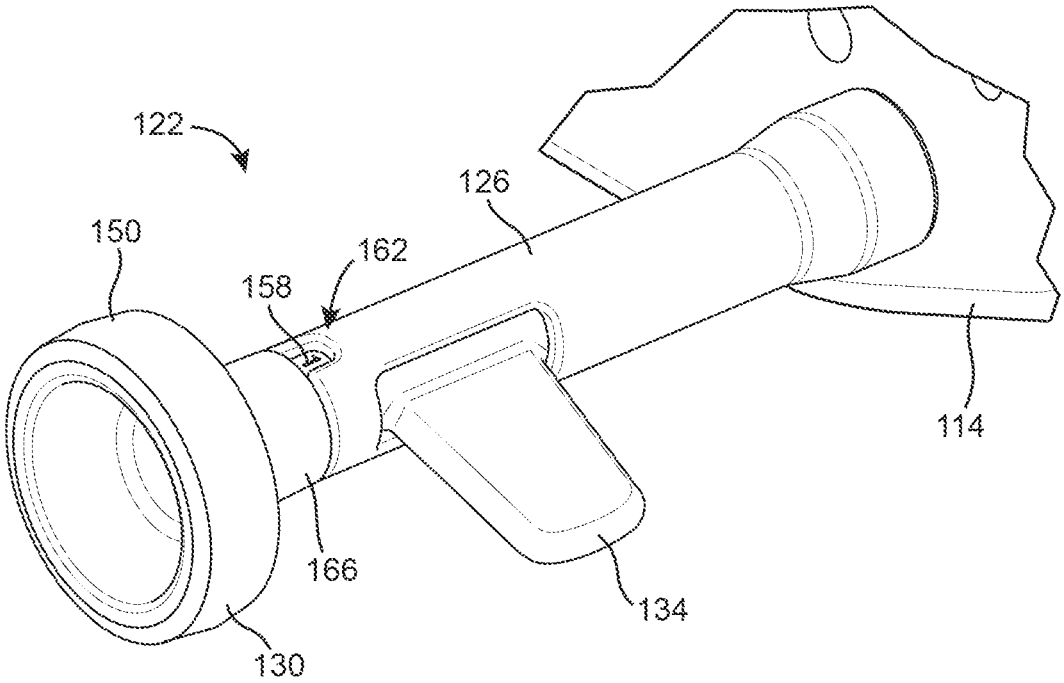
FIG. 6 is a perspective view of a control member of the tilt mechanism of FIG. 5.
Figure 7:
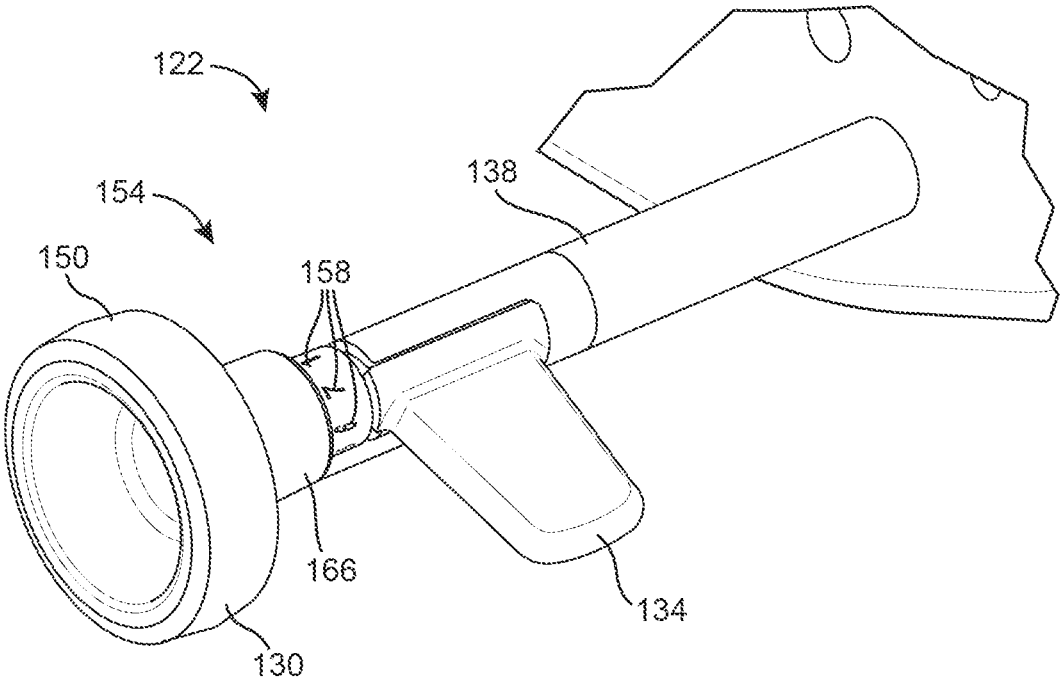
FIG. 7 is a perspective view of the control member of FIG. 6 with portions removed.
Figure 8:
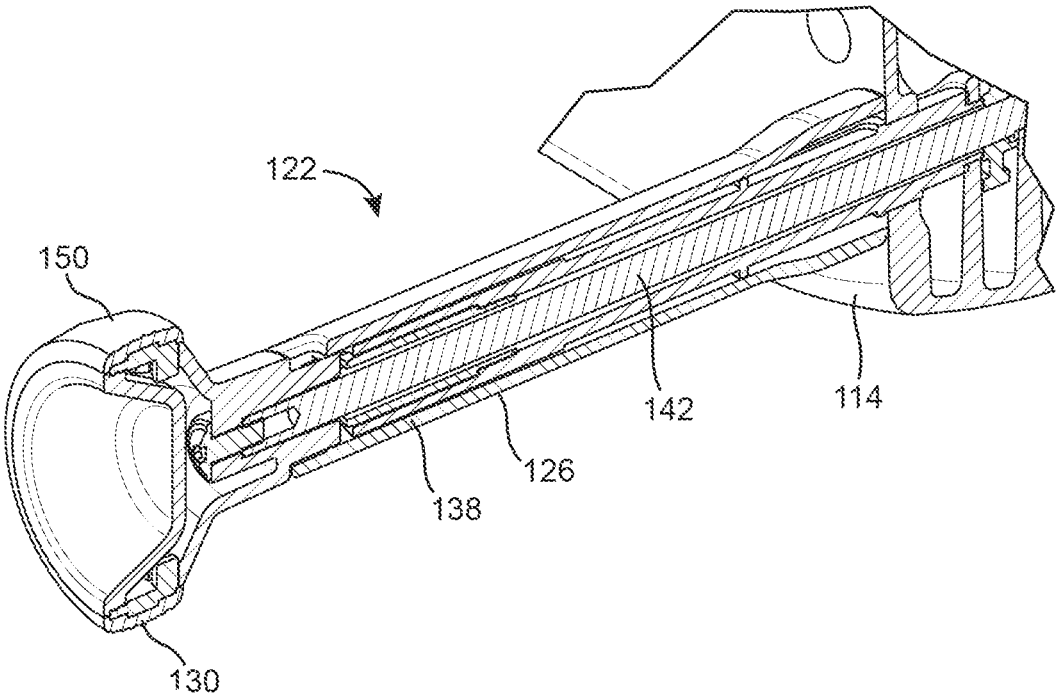
FIG. 8 is a cross-sectional view of the control member of FIG. 6.

With reference to FIGS. 6-8, the second control member 122 includes a control housing 126 coupled to the tilt housing 114. The control housing 126 supports a selector knob 130, a variable lever 134, a support tube 138, and a rod 142. The selector knob 130 is coupled to the rod 142 for co-rotation therewith. The rod 142 extends into the tilt housing 114 and is coupled to internal components of the tilt mechanism 30 that control the amount of force required to recline the backrest 22 relative to the seat 18. The selector knob 130 and the rod 142 are rotatable relative to the control housing 126 to adjust the amount of force required to recline the backrest 22 relative to the seat 18.

The selector knob 130 includes a grip 150 and a dial 154 extending from the grip 150. The dial 154 includes a plurality of indicia 158 extending circumferentially about the dial 154. In the illustrated embodiment, the indicia 158 are numerical values (i.e., 1, 2, 3 . . . ). The numerical values are full numbered integers. In other embodiments, the indicia 158 may be other symbols or pictures that are associated with a certain setting of the second control member 122. For examples, the indicia 158 may be letters, words, shapes, colors, and the like. The indicia 158 can be seen through a window 162 (FIG. 6) defined by the control housing 126 and an abutment 166 of the dial 154.

When a user rotates the selector knob 130, the rod 142 also rotates to adjust the amount of force required to recline the backrest 22 relative to the seat 18. Simultaneously, the dial 154 rotates with the selector knob 130 and displays the indicia 158 associated with a certain setting of the second control member 122 through the window 162. In the illustrated embodiment, the full range of settings of the second control member 122 are within a 360-degree range. In other words, all of the settings of the second control member 122 can be selected through one complete turn of the selector knob 130. As such, the same indicia 158 is never displayed twice during rotation of the selector knob 130.

Providing a control member including quantitative feedback that indicates to a user a certain setting allows the user to easily return to a preferred setting. For example, if another user were to make adjustments to the control member, if the user were to accidentally adjust the control member, or the user moves to a new chair of the same style, the user would be able to easily return the control member to their preferred setting.

Although the control member with quantitative feedback has been described in reference to a tilt tensioner, the seating structure 10 may include other control members with quantitative feedback. For example, the seating structure 10 may include control members such as an armrest adjuster, a seat adjuster, or a height adjuster that all include quantitative feedback.

Figure 9:
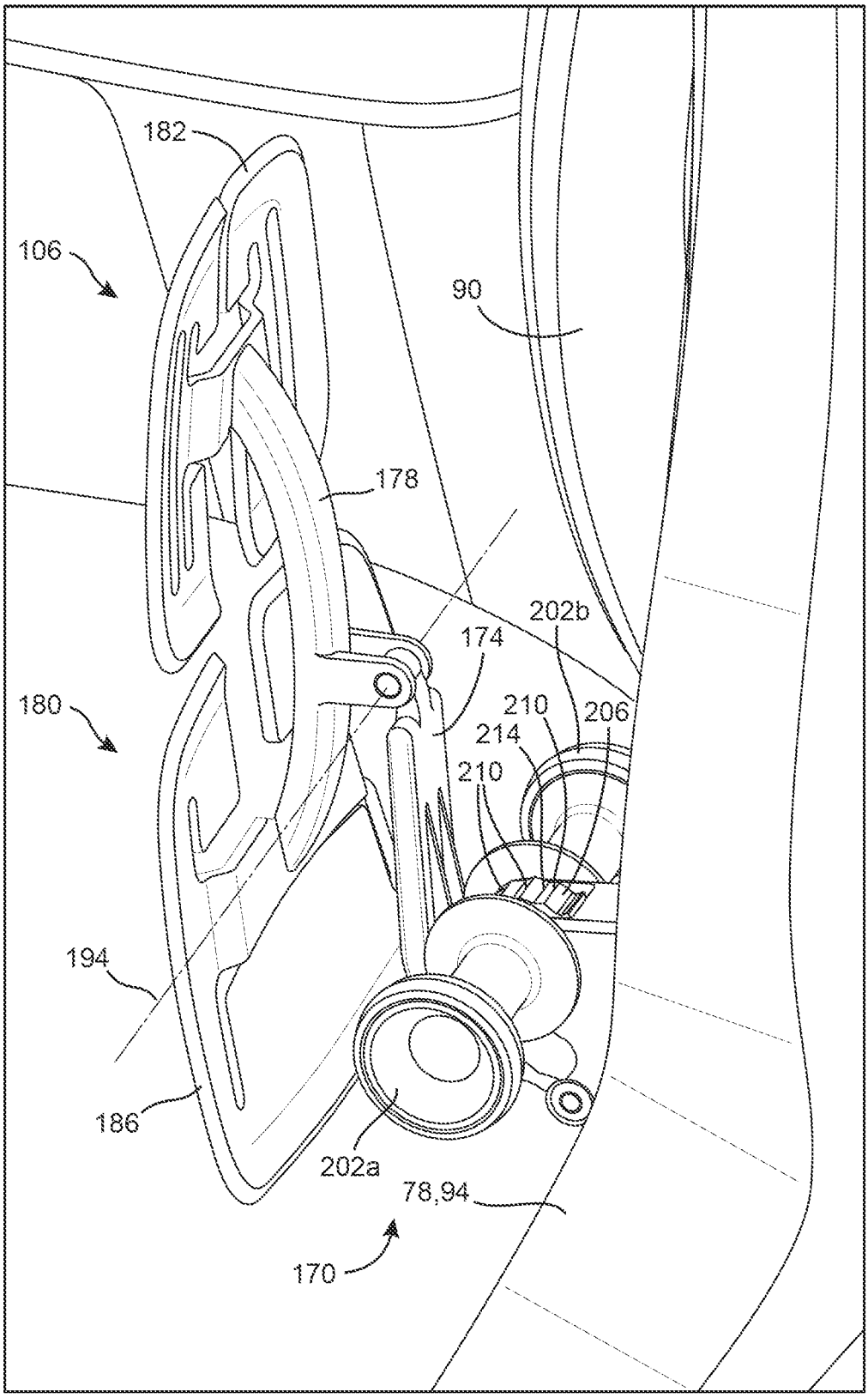
FIG. 9 is a perspective view of a lumbar support assembly for the seating structure of FIG. 1.
Figure 10:
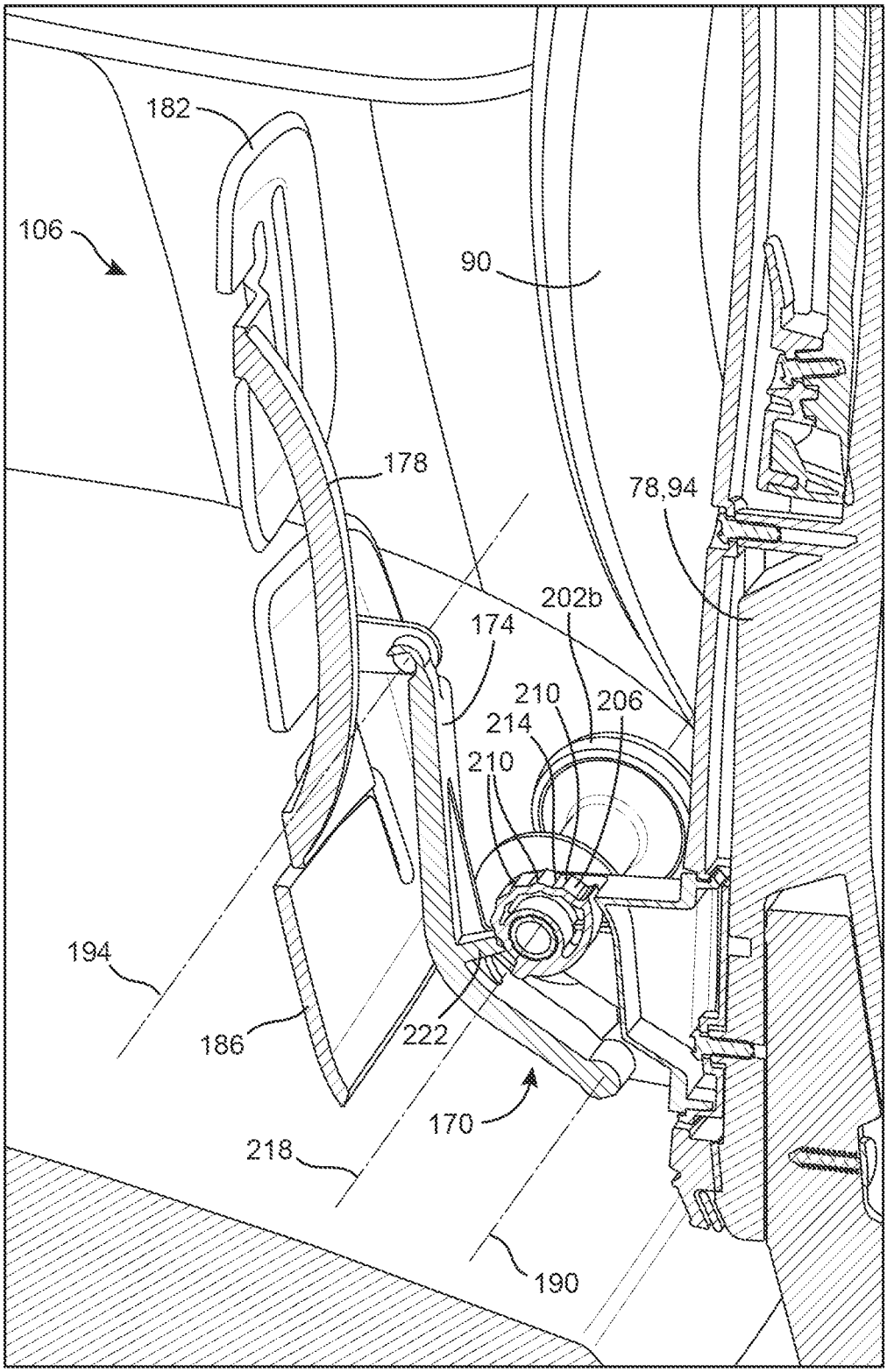
FIG. 10 is a cross-sectional view of the lumbar support assembly of FIG. 9

Referring to FIGS. 9 and 10, the lumbar support assembly 106 is coupled to the backrest 22. The illustrated lumbar support assembly 106 includes an adjustment member 170, a bracket assembly 172 having a first support bracket 174 and a second support bracket 178 that supports a lumbar support 180 having an upper lumbar support pad 182 and a lower lumbar support pad 186. The first support bracket 174 includes a first end that is pivotably coupled to the frame 78 of the backrest 22 about a first pivot axis 190 and a second end that is pivotably coupled to the second support bracket 178 about a second pivot axis 194. The first and second pivot axes 190, 194 are parallel to each other. The second support bracket 178 includes a first end that supports the upper lumbar support pad 182 and a second end that supports the lower lumbar support pad 186. The upper and lower lumbar support pads 182, 186 engage the suspension material 110 to provide support to a user's lumbar region (i.e., lower back). Both the upper and lower lumbar support pads 182, 186 may be deflectable to form to a shape of a user sitting in the seating structure 10. In some embodiments, the lumbar support assembly 106 may only include a single lumbar support pad. In other embodiments the lumbar support assembly 106 may include more than two lumbar support pads.

The first support bracket 174 extends forwardly from the central spine 94 of the frame 78 toward a user, but is pushed backward toward the central spine 94 by the suspension material 110. The adjustment member 170 is selectively rotatable to move the first support bracket 174 against the force of the suspension material 110 (e.g., toward the suspension material 110) to provide a user with more support through the upper and lower lumbar supports 182, 186. The adjustment member 170 is coupled to the central spine 94 of the frame 78 through a bracket 198 (FIG. 4). The adjustment member 170 includes first and second knobs 202*a*, 202*b* and a cam member 206. The first and second knobs 202*a*, 202*b* and the cam member 206 are coupled together for co-rotation. The first knob 202*a* extends from a first side of the lumbar support assembly 106, and the second knob 202*b* extends from a second side of the lumbar support assembly 106 opposite the first knob 202*a* such that the lumbar support assembly 106 can be adjusted from either side. In some embodiments, the adjustment member 170 may only include one knob. The cam member 206 includes a plurality of ridges 210 that define valleys 214 therebetween. The distance from a rotation axis 218 of the adjustment member 170 and the valleys 214 progressively increases in a circumferential direction of the cam member 206 (e.g., a clockwise direction as viewed from FIG. 10). The cam member 206 is engageable with a projection 222 (i.e., an engagement member) on the first support bracket 174 to move the first support bracket 174 toward the suspension material 110.

A user can adjust the amount of support provided by the upper and lower lumbar support pads 182, 186 by rotating either the first or second knob 202*a*, 202*b*. Specifically, a user can rotate one of the knobs 202*a*, 202*b* in the counterclockwise direction (as viewed in FIG. 10) to increase the support provided by the upper and lower lumbar supports 182, 186. As the knobs 202*a*, 202*b* are rotated counterclockwise, the cam member 206 is also rotated counterclockwise and the ridges 210 engage the projection 222 on the first support bracket 174. The ridges 210 force the first support bracket 174 away from central spine 94 until the projection 222 is seated in an adjacent valley 214. Due to the increasing distance between the rotation axis 218 and the valleys 214, the further counterclockwise the cam member 206 is rotated, the further the first support bracket 174 is pivoted away from the central spine 94. The further the first support bracket 174 is pivoted away from the central spine 94, the more the upper and lower lumbar supports 182, 186 push into the suspension material 110 to provide support to a user sitting in the seating structure 10. The cam member 206 may also be rotated clockwise to pivot the first support bracket 174 closer to the central spine 94. As the first support bracket 174 is pivoted towards the central spine 94, the upper and lower lumbar supports 182, 186 provide less support to the suspension material 110. A user may rotate the knobs 202*a*, 202*b* both clockwise and counterclockwise until a preferred amount of support is given by the upper and lower lumbar supports 182, 186. Additionally, the second support bracket 178 may pivot about the second pivot axis 194 to adjust the rotational position of the upper and lower lumbar supports 182, 186 based on how the back of a user engages the suspension material 110.

As noted above, either or both of the knobs 202*a*, 202*b* may include a quantitative feedback indicator (similar to the control member 122 of the tilt mechanism 30) that indicates a current setting of the lumbar support assembly 106.

Figure 11:
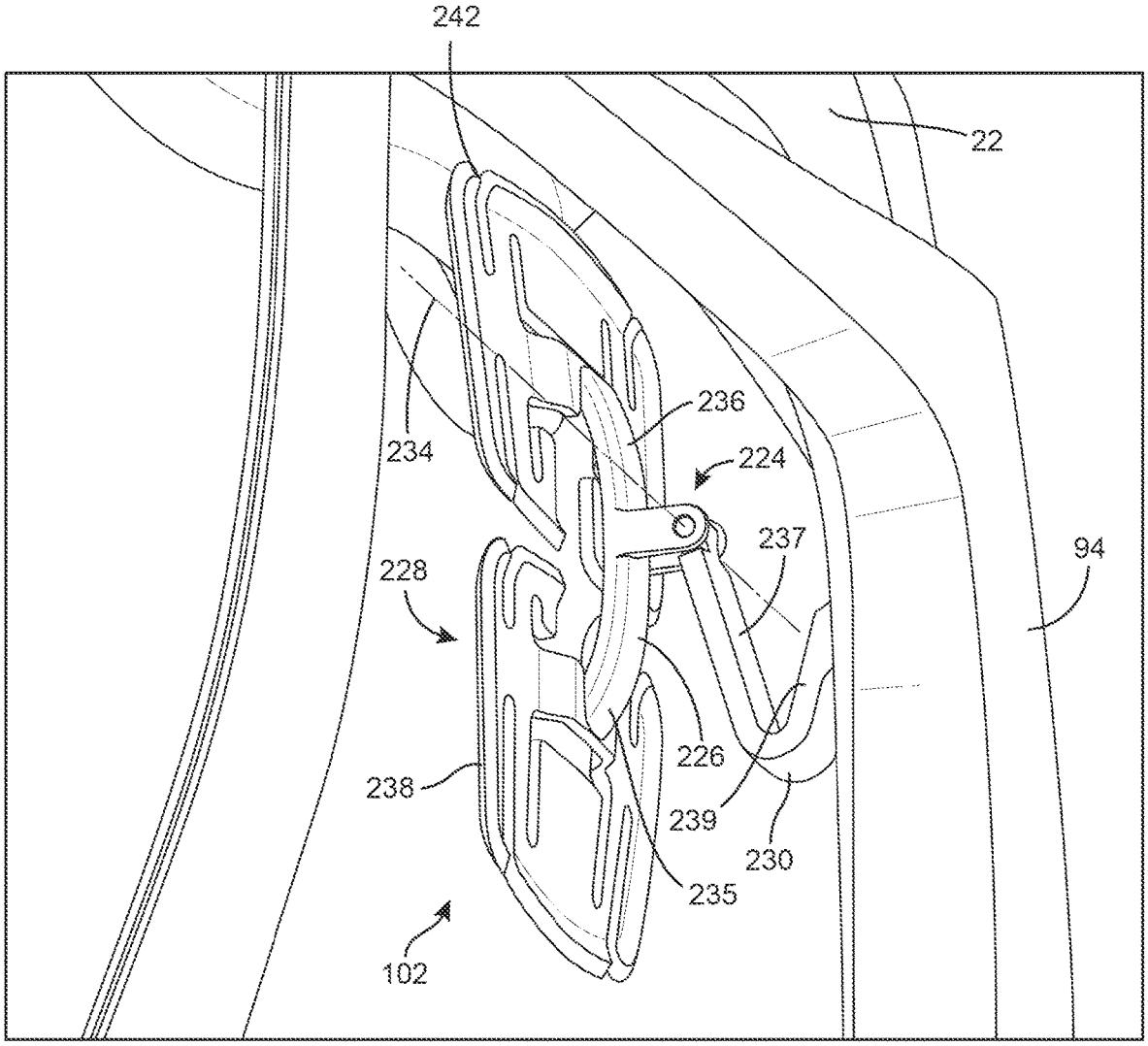
FIG. 11 is a perspective view of an upper thoracic support assembly for the chair of FIG. 1.
Figure 12:
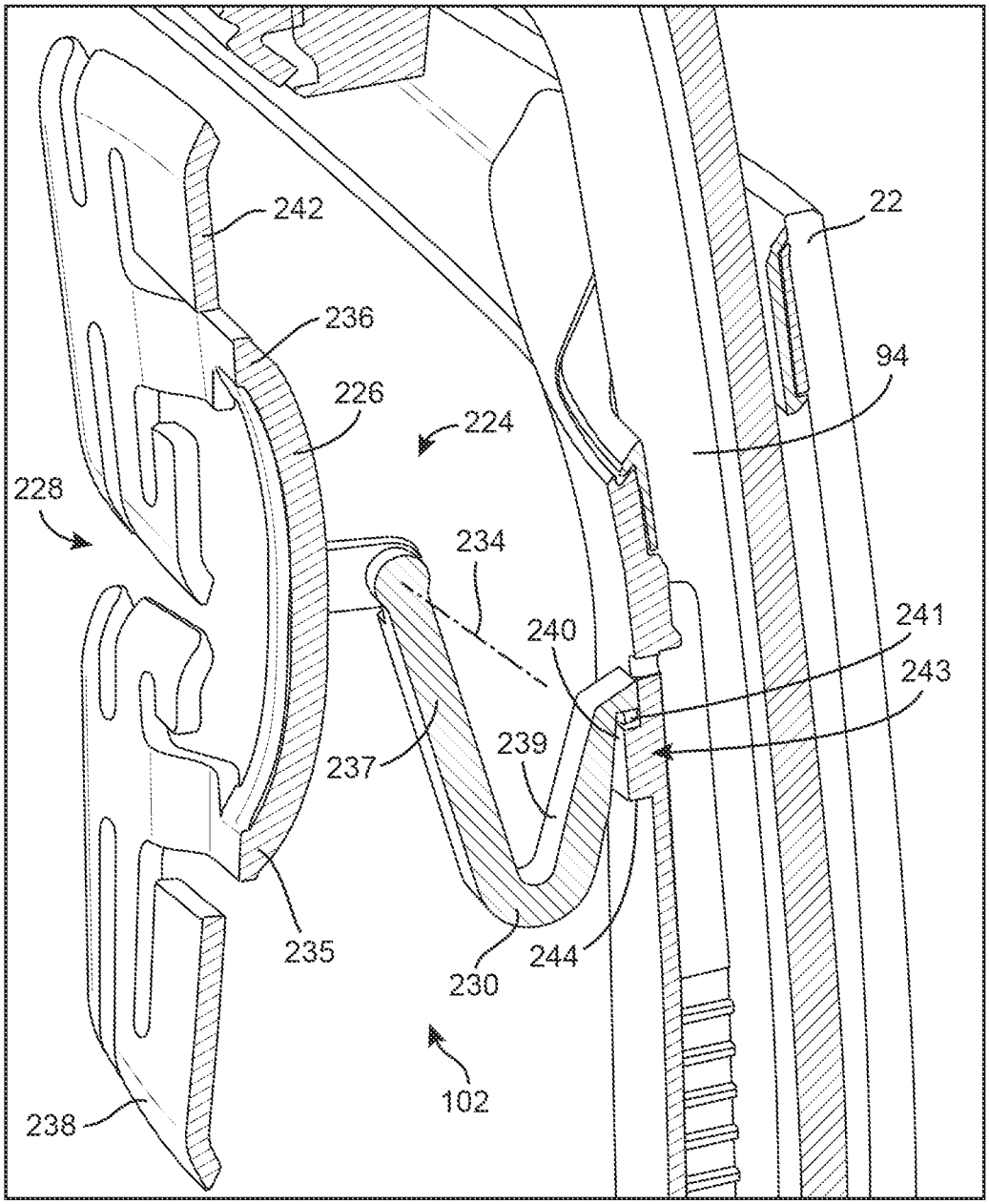
FIG. 12 is a cross-sectional view of the upper thoracic support assembly for the chair of FIG. 1.

With reference to FIGS. 11 and 12, the upper thoracic support assembly 102 is coupled to the backrest 22 adjacent the upper end 82. The upper thoracic support assembly 102 is positioned generally above the lumbar support assembly 106. The illustrated upper thoracic support assembly 102 includes a bracket assembly 224 including a first support bracket 226 that supports an upper thoracic support 228 and a second support bracket 230 pivotably coupled to the first support bracket 226 about a third pivot axis 234. The first support bracket 226 is a C-shaped bracket including a first end 235 and a second end 236 opposite the first end 235. The second support bracket 230 is a V-shaped bracket including a first arm portion 237 and a second arm portion 239. The first arm portion 237 is pivotably coupled to the first support bracket 226 in between the first and second ends 235, 236. The second arm portion 239 is coupled to the central spine 94 of the frame 78. Specifically, with reference to FIG. 12, the second arm portion 239 defines an opening 240 with a hook 241 that couples into a slot 243 of a clip 244 on the central spine 94. As such, the second support bracket 230 and thus the upper thoracic support assembly 102 may be removably coupled to the central spine 94 by lifting the hook 241 out of the slot 243 of the clip 244.

The upper thoracic support 228 includes a lower thoracic support pad 238 coupled to the first end 235 of the first support bracket 226 and an upper thoracic support pad 242 coupled to the second end 236 of the first support bracket 226. In some embodiments, the upper thoracic support assembly 102 may only include a single support pad. In other embodiments, the upper thoracic support assembly 102 may include more than two support pads. Similar to the upper and lower lumbar support pads 182, 186, the upper and lower thoracic support pads 238, 242 may be deflectable to engage a user's thoracic region (i.e., upper back).

During use of the seating structure 10, the lower and upper thoracic support pads 238, 242 may be pivoted about the third pivot axis 234 to properly engage a user's back. In other words, the first support bracket 226 may pivot similar to a teeter-totter, to engage the thoracic region of a user when a user sits in the seating structure 10. The second support bracket 230 is naturally biased away from the central spine 94 to position the upper thoracic support 228 and the thoracic support pads 242, 246 between the frame 78 and the suspension material 110. In other words, the second support bracket 230 is a resilient cantilevered bracket that naturally biases the upper thoracic support 228 away from the central spine 94. In addition, the second support bracket 230 positions the thoracic support pads 242, 246 slightly behind or away from the suspension material 110 when in a rest position (i.e., when a user in not seated in the seating structure 10). When a user engages the suspension material 110, the thoracic support pads 242, 246 engage the thoracic region of the user. As a user further leans against the backrest 22, the second support bracket 230 begins to deflect and move towards the central spine 94. In some embodiments, the first support bracket 226 may be biased towards or away from the central spine 94 by a torsion spring to provide support to a user through the upper and lower thoracic support pads 238, 242. In some embodiments, the upper thoracic support assembly 102 may include an adjustment member to adjust the position of the first support bracket 226 relative to the central spine 94.

Figure 13:
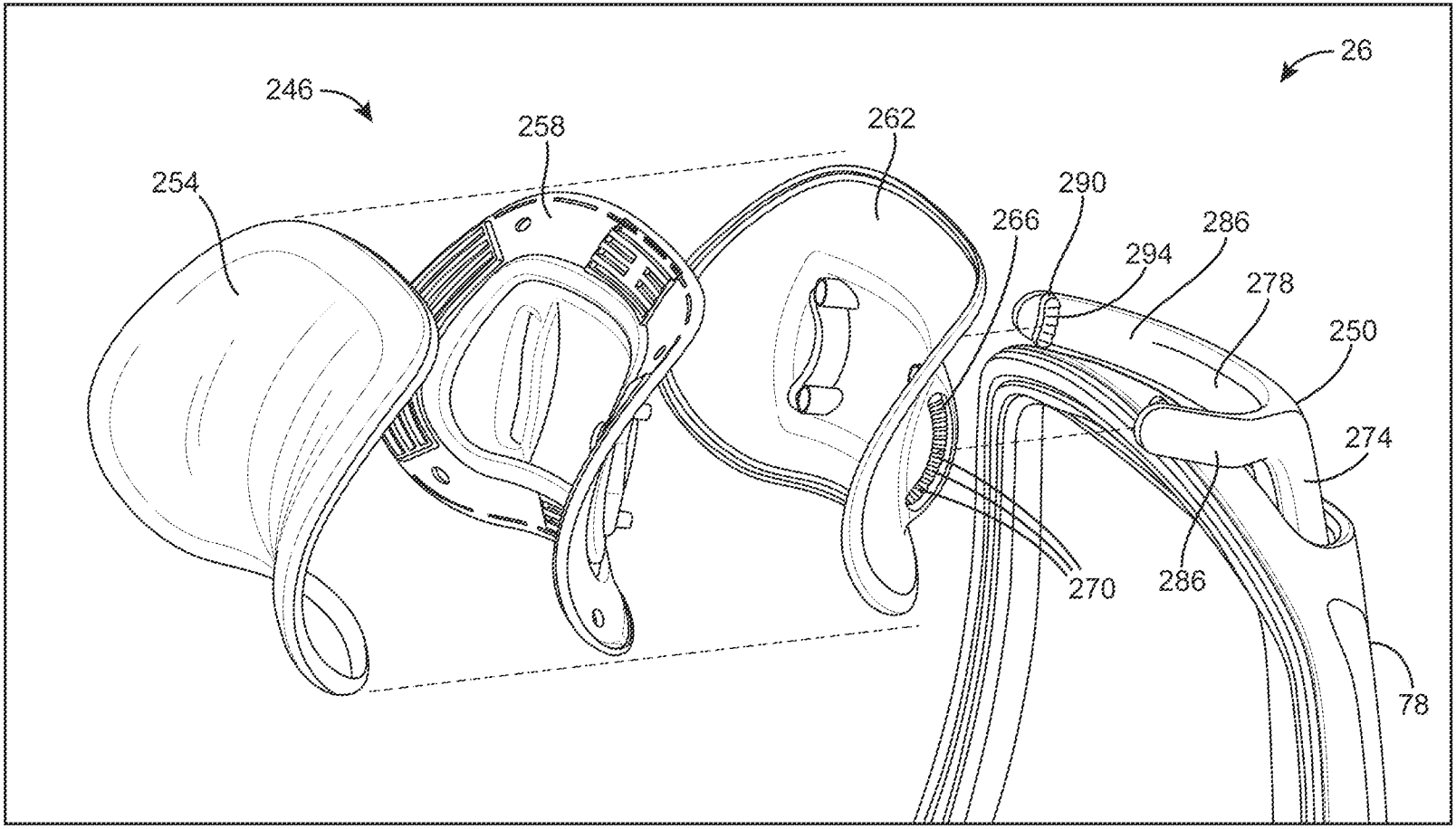
FIG. 13 is an exploded view of a headrest assembly of the chair of FIG. 1.

With reference to FIG. 13, the headrest assembly 26 is supported by the backrest 22. The illustrated headrest assembly 26 includes a headrest 246 and a stem 250. The headrest 246 includes a support pad 254, a middle frame 258, and a back frame 262. The support pad 254 is coupled to the middle frame 258, and the middle frame 258 is coupled to the back frame 262 with fasteners. The back frame 262 includes two grooves 266 (only one is shown in FIG. 13) on a back side thereof. The grooves 266 are positioned on opposing sides of the back frame 262. In the illustrated embodiment, the grooves 266 are arcuate grooves. Each groove 266 includes a plurality of peaks and valleys 270 extending along an arcuate path of the grooves 266. The grooves 266 are forward facing relative to the seat 18. In other words, the arcuate grooves 266 are focused about a point that is positioned forward of the headrest 246.

The stem 250 includes an elongated shaft 274 and a yoke 278 extending from the elongated shaft 274. The elongated shaft 274 is positioned and supported within a channel 282 (FIG. 18) of the central spine 94. The elongated shaft 274 also extends through the opening in the frame 78 formed by the arms 98 (FIG. 3). The yoke 278 includes two support arms 286 that extend from the elongated shaft 274 towards the headrest 246. At the end of both of the support arms 286 is an engagement member. In the illustrated embodiment, the engagement members are protrusions 290. The protrusions 290 are similarly shaped as the grooves 266. In the illustrated embodiment, the protrusions 290 are arcuate protrusions. Each of the protrusions 290 includes peaks and valleys 294 that correspond to the peaks and valleys 270 of the grooves 266. When assembled, the protrusions 290 are positioned within the grooves 266 for movement relative to the headrest 246 within the grooves 266. The peaks and valleys 294 of the protrusions 290 engage the peaks and valleys 270 of the grooves 266 to releasably secure the headrest 246 in a preferred position. The support arms 286 of the yoke 278 provide enough inward force to the protrusions 290 to keep the headrest 246 supported by the stem 250. Although the illustrated headrest 246 includes the grooves 266 and the illustrated support arms 286 include the protrusions 290, in other embodiments the headrest 246 may include protrusions and the support arms 286 may include grooves.

Figure 14:
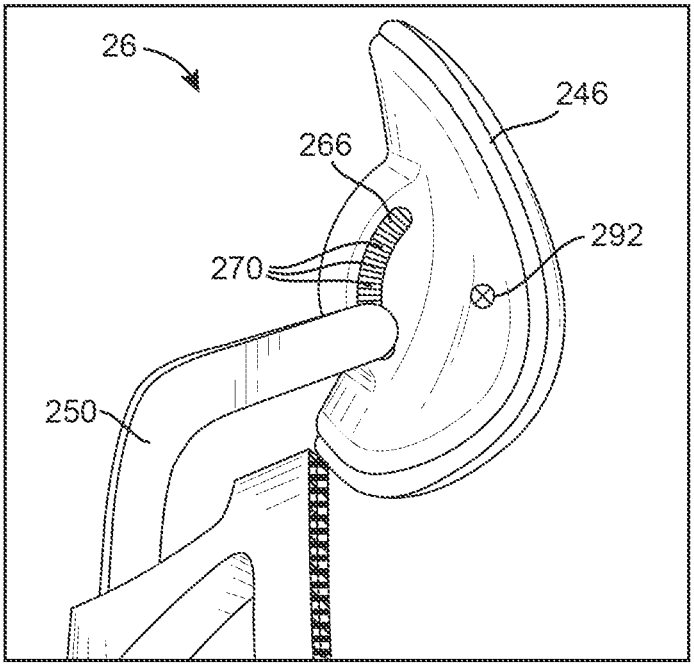
FIG. 14 is a side view of the headrest assembly in a first position.
Figure 15:
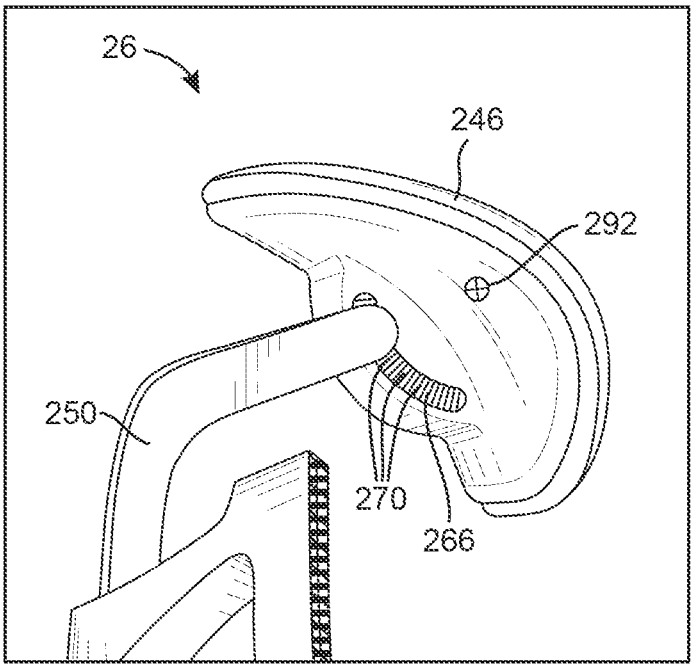
FIG. 15 is a side view of the headrest assembly in a second position.

As shown in FIGS. 14 and 15, the headrest 246 is moveable between a plurality of positions relative to the stem 250 to adjust the angular position of the headrest 246. A user may tilt their head while sitting in the seating structure 10 to adjust the position of the headrest 246 relative to the stem 250. As a user moves the headrest 246, the protrusions 290 are guided along an arcuate path by the grooves 266. The headrest 246 thereby pivots about a virtual pivot axis 292 located in front of the headrest 246 (i.e., on the same side of the backrest 22 as the seat 18). The peaks and valleys 294 of the protrusion 290 slide over the peaks and valleys 270 of the grooves 266 as the protrusions 290 follow the arcuate path. The headrest 246 may be moved from a first extreme position (FIG. 14) at one end of the grooves 266 to a second extreme position (FIG. 15) at another end of the grooves 266. The protrusions 290 engage the ends of the grooves 266 to limit the headrest 246 from pivoting beyond the extreme positions. Once a user has selected a preferred orientation of the headrest 246, the peaks and valleys 294 of the protrusion 290 engage the peaks and valleys 270 of the groove 266 and vice versa to releasably secure the headrest 246 relative to the stem 250. Due to the inward force of the support arms 286, the protrusions 290 provide a sufficient force to cause the protrusions 290 to secure the headrest 246 in one of the plurality of positions. The force provided by the inward force of the support arms 286 may easily be overcome if the user wants to change the positions without having to actuate a latch or other mechanism.

Figure 16:
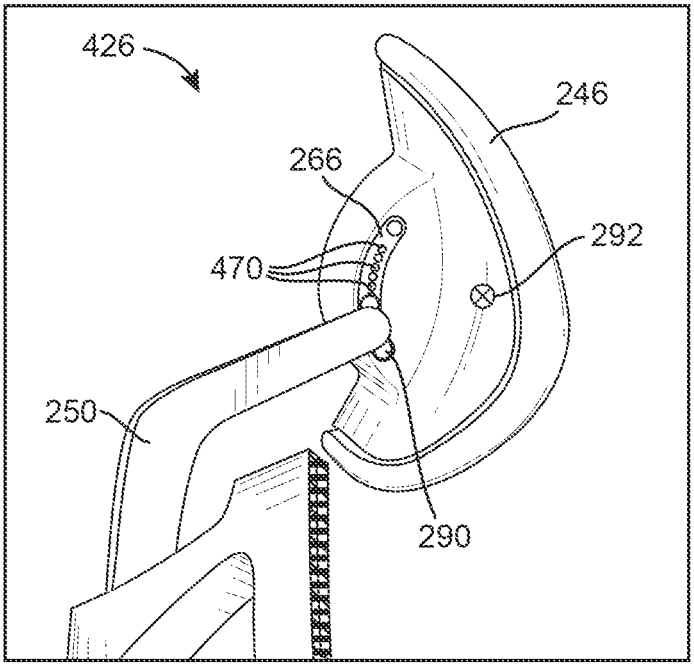
FIG. 16 is a side view of a headrest assembly according to another embodiment in a first position.
Figure 17:
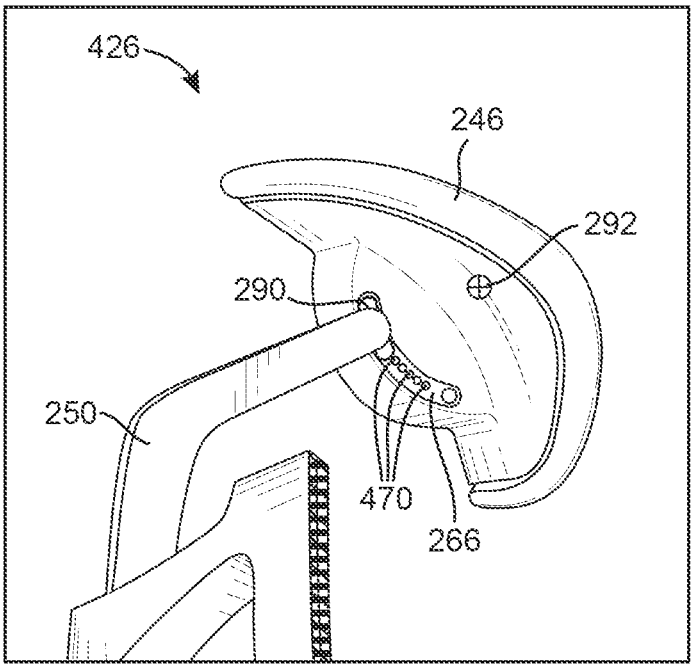
FIG. 17 is a side view of the headrest assembly of FIG. 16 in a second position.

FIGS. 16 and 17 illustrate a headrest assembly 426 according to another embodiment. The headrest assembly 426 is similar to the headrest assembly 26 with like features being represented with like reference numbers. The headrest assembly 426 includes the groove 266, but instead of peaks and valleys 270, the groove 266 includes a plurality of detents 470 that correspond to a plurality of angular positions of the headrest 246. In addition, the protrusions 290 includes a locking member partially extending from each of the protrusions 290. The locking members may be, for example, ball detents. The ball detents are biased out of the protrusions 290 by resilient members (e.g., a spring). The ball detents are configured to engage one of the detents 470 in the grooves 266 to releasably secure the headrest 246 in a preferred position. The headrest assembly 426 functions generally the same as the headrest assembly 26 discussed above. The headrest 246 may be moved from a first extreme position (FIG. 16) at one end of the grooves 266 to a second extreme position (FIG. 17) at another end of the grooves 266. Once a user has selected a preferred orientation of the headrest 246, the ball detents releasably secure the headrest 246 relative to the stem 250. The resilient members provide a sufficient force to cause the ball detents to secure the headrest 246 in one of the plurality of positions. The force provided by the resilient members may easily be overcome if the user wants to change the position without having to actuate a latch or other mechanism.

Figure 18:
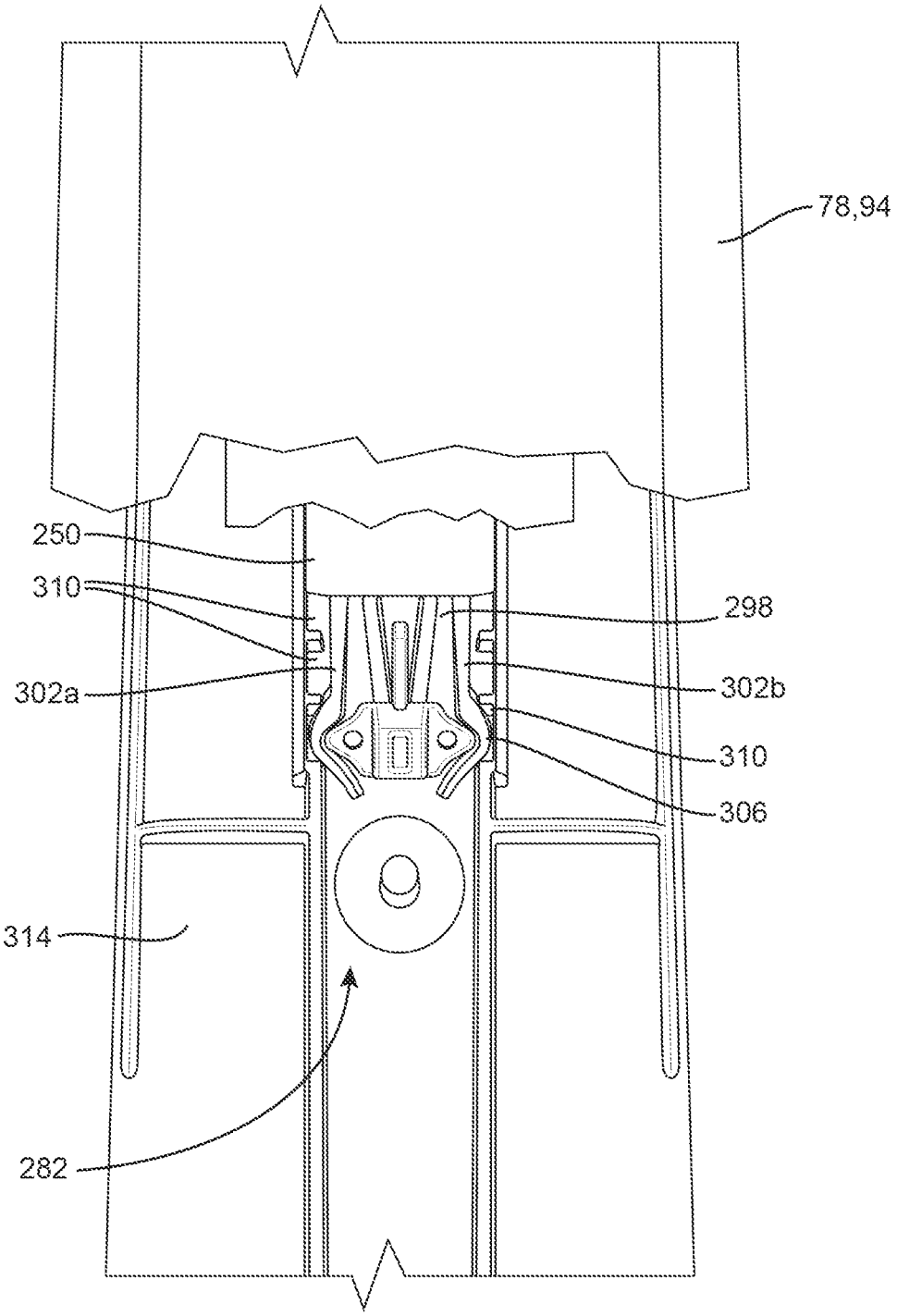
FIG. 18 is a cross-sectional view of portions of the headrest assembly and a backrest of the seating structure.

The headrest assembly 26 is also moveable relative to the frame 78 to adjust the vertical height of the headrest assembly 26. As shown in FIG. 18, the headrest assembly 26 includes a lock member 298 that is coupled to a lower end of the stem 250. The lock member 298 includes a pair of resilient legs 302*a*, 302*b* that are biased away from each other. The legs 302*a*, 302*b* of the lock member 298 includes projections 306 that corresponds to a plurality of detents 310 in a front cover 314 of the frame 78. As the stem 250 is moved in a vertical direction, the projections 306 are biased to engage one of the detents 310 in the front cover 314. Similar to the resilient members discussed above, the resilient legs 302*a*, 302*b* are biased with a sufficient force to support the headrest assembly 26 in one of the plurality of positions corresponding to the detents 310. A user can easily overcome the biasing force when moving the headrest assembly 26 in the vertical direction to adjust the height of the headrest assembly 26 without having to actuate a latch or other mechanism.

In other embodiments, the lock member 298 may use ball detents to lock the headrest assembly 26 in a preferred position. The ball detents may correspond to a plurality of detents inside the channel 282 of the central spine 94.

As noted above, the headrest assembly 26 may include a quantitative feedback indicator (similar to the control member 122 of the tilt mechanism 30) that indicates a current setting (e.g., vertical height) of the headrest 246.

Various features and advantages are set forth in the following claims.

What is claimed is:

1. A seating structure comprising:
a base;
a seat supported by the base;
a backrest including a frame and a suspension material supported by the frame, the frame including an upper end, a lower end opposite the upper end, and a central spine; and
an upper thoracic support assembly supported by the frame adjacent the upper end, the upper thoracic support assembly including a thoracic support pad positioned between the frame and the suspension material and a V-shaped bracket that couples the support pad to the central spine, the thoracic support pad configured to engage the suspension material to support an upper thoracic region of a user.

2. The seating structure of claim 1, further comprising a lumbar support assembly supported by the frame adjacent the lower end, the lumbar support assembly including a lumbar support pad configured to engage the suspension material to support a lumbar region of a user.

3. The seating structure of claim 1, further comprising a headrest assembly coupled to the frame.

4. The seating structure of claim 1, wherein the frame also includes outer uprights positioned on opposite sides of the central spine, and wherein the outer uprights and the central spine are contiguous to form the frame.

5. The seating structure of claim 1, wherein the upper thoracic support assembly includes a first bracket coupled to the thoracic support pad, and wherein the V-shaped bracket is coupled to the first bracket, and wherein the first bracket is pivotable relative to the V-shaped bracket.

6. The seating structure of claim 1, wherein the upper thoracic support pad is a lower thoracic support pad, and wherein the upper thoracic support assembly also includes an upper thoracic support pad.

7. The seating structure of claim 1, wherein the upper thoracic support pad is pivotably coupled to the frame about a pivot axis.

8. The seating structure of claim 1, wherein the upper thoracic support pad is biased away from the frame and toward the suspension material.

9. The seating structure of claim 8, wherein the V-shaped bracket biases the upper thoracic support away from the frame and toward the suspension material.

10. A seating structure comprising:
a base;
a seat supported by the base;
a backrest including a frame; and
a headrest assembly supported by the backrest, the headrest assembly including
a stem coupled to and extending from the frame, and
a headrest coupled to an end of the stem, the headrest pivotable relative to the stem about a virtual pivot axis spaced apart from the end of the stem and positioned on a same side of the backrest as the seat and extending through the headrest;
wherein the stem is moveable relative to the frame to adjust a vertical height of the headrest assembly.

11. The seating structure of claim 10, wherein the stem includes a lock member having a projection that selectively engages detents in the frame to releasably secure the stem in a plurality of vertical positions.

12. The seating structure of claim 10, wherein either the stem or the headrest includes an arcuate groove and the other of the stem or headrest includes an engagement member, and wherein the engagement member engages the arcuate groove for movement along an arcuate path defined by the arcuate groove between a plurality of positions.

13. The seating structure of claim 12, wherein the engagement member includes a locking member that engages the arcuate groove to support the engagement member in one of the plurality of positions.

14. The seating structure of claim 12, wherein the arcuate groove includes a plurality of first peaks and valleys, wherein the engagement member includes a plurality of second peaks and valleys, and wherein the first peaks and valleys engage the second peaks and valleys to support the engagement member in one of the plurality of positions.

15. The seating structure of claim 10, wherein the stem includes an elongated shaft supported by the frame and a yoke extending from the stem that supports the headrest.

16. The seating structure of claim 10, wherein the headrest includes a frame and a support pad coupled to the frame.

17. The seating structure of claim 16, wherein the virtual pivot axis extends through the support pad.

18. A seating structure comprising:
a base;
a seat supported by the base;
a backrest including a frame and a suspension material coupled to the frame; and
a lumbar support assembly coupled to the backrest, the lumbar support assembly including,
a support bracket having a first end pivotably coupled to the frame and a second end opposite the first end;
a lumbar support pad coupled to the second end of the support bracket, and
an adjustment member positioned between the support bracket and the frame, the adjustment member having a cam member, the cam member rotatable about a rotational axis to engage the support bracket and adjust the position of the lumbar support pad relative to the suspension material;

wherein the adjustment member includes a knob to rotate the cam member about the rotational axis;

wherein the knob is a first knob accessible from a first side of the seating structure, and wherein the adjustment member includes a second knob accessible from a second side of the seating structure.

19. The seating structure of claim 18, wherein the cam member includes a plurality of ridges that define valleys, and wherein a distance between the rotational axis and the valleys progressively increases in a circumferential direction of the cam member.

20. The seating structure of claim 19, wherein the support bracket includes an engagement member that engages the valleys to position the lumbar support pad relative to the suspension material.

21. The seating structure of claim 18, wherein the lumbar support pad is pivotably coupled to the first end of the support bracket.

22. The seating structure of claim 18, wherein the first or second knob is rotatable in a first direction, in which the support bracket is pivoted towards the suspension material, and the first or second knob is rotatable in a second direction opposite the first direction, in which the support bracket is pivoted away from the suspension material.

23. A seating structure comprising:

a base;

a seat supported by the base;

a backrest including a frame; and a headrest assembly supported by the backrest, the headrest assembly including a stem coupled to and extending from the frame, and a headrest coupled to an end of the stem, the headrest pivotable relative to the stem about a virtual pivot axis spaced apart from the end of the stem and positioned on a same side of the backrest as the seat and extending through the headrest;

wherein either the stem or the headrest includes an arcuate groove and the other of the stem or headrest includes an engagement member, and wherein the engagement member engages the arcuate groove for movement along an arcuate path defined by the arcuate groove between a plurality of positions; and wherein the engagement member includes a locking member that engages the arcuate groove to support the engagement member in one of the plurality of positions.

24. A seating structure comprising:

a base;

a seat supported by the base;

a backrest including a frame; and a headrest assembly supported by the backrest, the headrest assembly including a stem coupled to and extending from the frame, and a headrest coupled to an end of the stem, the headrest pivotable relative to the stem about a virtual pivot axis spaced apart from the end of the stem and positioned on a same side of the backrest as the seat and extending through the headrest;

wherein either the stem or the headrest includes an arcuate groove and the other of the stem or headrest includes an engagement member, and wherein the engagement member engages the arcuate groove for movement along an arcuate path defined by the arcuate groove between a plurality of positions;

wherein the arcuate groove includes a plurality of first peaks and valleys, wherein the engagement member includes a plurality of second peaks and valleys, and wherein the first peaks and valleys engage the second peaks and valleys to support the engagement member in one of the plurality of positions.

* * * * *